United States Patent [19]

Jacob et al.

[11] Patent Number: 4,768,271

[45] Date of Patent: Sep. 6, 1988

[54] TOOL FOR REMOVAL AND INSTALLATION OF FLUID COUPLING RETAINING PIN

[75] Inventors: Richard J. Jacob, Dayton; James D. Fox, West Chester, both of Ohio

[73] Assignee: Dayco Products, Inc., Dayton, Ohio

[21] Appl. No.: 623,531

[22] Filed: Jun. 21, 1984

Related U.S. Application Data

[63] Continuation of Ser. No. 387,982, Jun. 14, 1982, abandoned.

[51] Int. Cl.[4] ..... B25B 27/00; B25C 11/00

[52] U.S. Cl. ..... 29/267; 29/270; 254/28

[58] Field of Search ..... 81/3 CP, 3 R; 29/270, 29/247, 267; 254/25, 28, 131

[56] References Cited

U.S. PATENT DOCUMENTS

| | | | |
|---|---|---|---|
| D. 33,820 | 1/1901 | Faurest | 254/28 X |
| 1,802,687 | 4/1931 | Vrana | 254/28 |
| 2,772,898 | 12/1956 | Seeler | 285/190 |

OTHER PUBLICATIONS

Hi-Flex International Limited Catalog, "Hi-Flex Staplelock", Nov. 1977.

*Primary Examiner*—Mark Rosenbaum
*Attorney, Agent, or Firm*—Joseph V. Tassone

[57] ABSTRACT

A tool used for removal and installation of a fluid coupling retaining pin. The tool consists of long, narrow handle terminating in a body having a flat upper surface and an arcuately curved lower surface, one end of the upper surface being notched to fit under the loop of the retaining pin. The curved lower surface fits against the coupling, acting as a fulcrum for pulling the pin out of its groove. The tool also has sufficient mass so that it may be used to drive the pin into its groove as well.

5 Claims, 2 Drawing Sheets

TOOL FOR REMOVAL AND INSTALLATION OF FLUID COUPLING RETAINING PIN

This is a continuation of application Ser. No. 387,982 filed June 14, 1982 now abandoned.

BACKGROUND OF THE INVENTION

1. Field of the Invention

This invention is directed to a tool for removing a retaining pin from a fluid coupling wherein the pin is used to interlock two members of the coupling in order to provide a quick disconnect. The tool may also be used to install the pin to connect the members. The invention is also directed to a method of making such a tool, and also to the method for removing the pin.

The fluid couplings of the type referred to above are described in U.S. Pat. No. 2,772,898 to Seeler; U.S. Pat. No. 3,527,485 to Goward et al; U.S. Pat. No. 3,973,791 to Porta et al; and pending U.S. application Ser. No. 346,350, now U.S. Pat. No. 4,431,218, filed in the name of Vernon Paul, Jr. and James D. Fox, one of the co-inventors of this application.

2. Prior Art Statement

Tools or other devices for removing the retaining pin are not widely known. The following publications are pertinent:

Seeler U.S. Pat. No. 2,772,898 Dec. 4, 1956

Hi-Flex International Limited Catalog,

"Hi-Flex Staplelok", November 1977

The Seeler patent utilizes a pull cord secured to the pin, having a loop which is secured to an ejection seat of an aircraft. When the seat is ejected, the cord simultaneously removes the pin. This construction, however, is not intended to remove the pin under other circumstances.

The Hi-Flex Catalog illustrates a "staple extractor 609433" which is a handle with a bent rod attached. The end of the rod is hooked under the staple (retaining pin) for removal. It is also suggested that the staple be removed by finger pressure.

SUMMARY OF THE INVENTION

The fluid coupling of the type discussed herein consists of two members which are part of a fluid conveying system, being inner and outer members interengaged and sealed by O-Rings to prevent leakage of the fluid. The members are locked together by means of a U-Shaped retaining pin having legs which pass through openings in the outer member and into grooves in the outer surface of the inner member. The legs thus create a frictional lock between the members.

The members constitute a quick connect-disconnect arrangement, and it is obviously necessary to remove the retaining pin when the members are to be separated. If the assembly is properly fabricated, the pin is held very tightly in place because of an inherent design which tends to spring the legs outwardly and back into the openings of the outer member. Close tolerances of the legs of the pin, the holes in the outer member, and the grooves of the inner member, all create this tight fit. It is therefore important to find a means for overcoming these frictional forces in order to remove the pin—and also to install the pin—without too much difficulty.

The use of fingers for such a purpose is a poor approach to this problem of removal; as indicated above, a properly fabricated assembly will simply not allow such a removal. Any attempt will undoubtedly result in bruised fingers, cuts, and short tempers. A cable such as described by Seeler, would not be an improvement over fingers. A tool such as a screwdriver, is not conducive to easy removal, and may be dangerous because of flying pins. A pair of pliers may be used, but could lacerate the pin and cause damage to the grooves, holes, or the legs of the pin. A bent tool such as described in the Hi-Flex Catalog does not seem to have the proper mass or design to provide a fulcrum for easy removal.

Applicant has devised a tool and method of using the tool that provides the correct leverage for removing the pin, so that a minimum of effort is required. The mass of the unit aids in the removal, and insures that the tool will not deflect during use, and this mass also enables the tool to be used to drive the pin into the members for assembly. The special curved configuration of the tool also makes it simple to either pull the tool toward the user, or push it away, thus enhancing its versatility. And finally, the configuration provides a constant leverage throughout the range of travel for constant pulling or pushing action.

It is therefore, a principal object of this invention to provide a tool for simplified removal of a locking pin from a quick connect-disconnect fluid coupling assembly.

it is an additional object to provide a method for removing a locking pin, using said tool.

It is a further object to provide such a tool that can also be used to insert the locking pin in the assembly.

it is another object to form said tool so that it will provide a constant leverage for removing the pin.

These and other objects, uses, and advantages of the present invention are set forth in the following description and drawings.

DESCRIPTION OF THE PREFERRED EMBODIMENT

Figure 1:
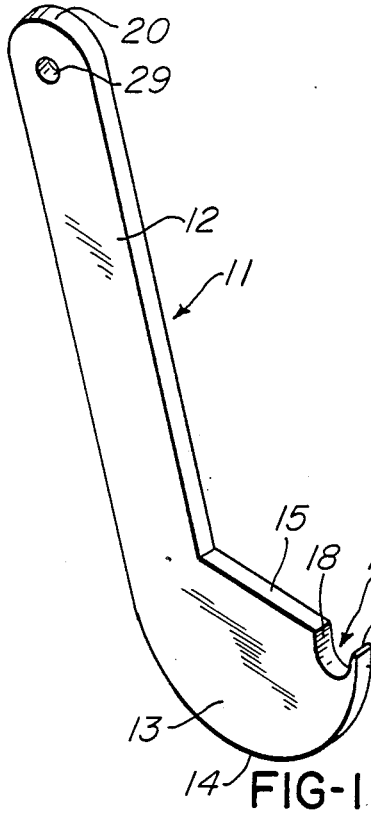
FIG. 1 is a perspective view of the novel retaining pin removal tool.

Referring to the drawings, FIG. 1 illustrates in detail the novel pin removal tool 11, which is preferably formed of a one-piece unitary member that may be about one quarter inch to one inch thick. The tool may be made of suitable metal, such as steel, by stamping, forging or casting; or may be made by molding from a high impact plastic material such as polycarbonate or ABS. The configuration of the tool is such that is lends itself to easy manipulation and highly effective operation throughout its travel. Primarily it consists of a narrow handle 12 extending at a slight angle to the main body 13, this body having a flat upper surface 15 and a curved lower surface 14 which is preferably in the form of an arc of a circle; hence it may be designated as arcuate. The depth of the body between the surfaces 14 and 15 is appreciable, constituting about one-fourth of the overall length of the tool, from the lower surface 14 to the top edge 20 of the handle. A hole 29 is located in the upper portion of the handle to serve as a convenient method of storing the tool by hanging it on a peg or nail.

At the end of the body opposite the handle, the curved lower portion terminates in an upward-facing lip 16, having a tip 17. A notch 19 is formed in the end of the body and is defined by the lip 16 and a short vertical wall 18 extending approximately at right angles to the flat surface 15. The notch may be of any convenient configuration, but as shown it is in the form of approximately a half circle, thus permitting the loop to fit into this semi-circular notch with greater ease. The curved lower surface 14, as stated above, is arcuate, forming slightly more than half a circle. One end of the curve blends smoothly into the lower end of the handle 12, and the other end terminates in the above-mentioned lip 16.

The pin to be removed is part of hose assembly 30, illustrated in FIGS. 2 to 6. The assembly 30 consists of an outer member 21, an inner member 22, a hose 23 coupled to member 22, and the locking pin 24 having legs 25 and 26 extending through openings 28 in the outer member and into grooves (not shown) in the inner member. Additional hose means are secured to member 21, but are omitted for clarity. It is understood that the omitted members as well as hidden parts of the assembly are not more fully described herein because they form no part of the invention. However, these details are set forth in the Goward et al and Porta et al patents referred to above, as well as in the Copending application set forth above (all under "Field of the Invention"), and these details are specifically incorporated by reference herein.

Figure 2:
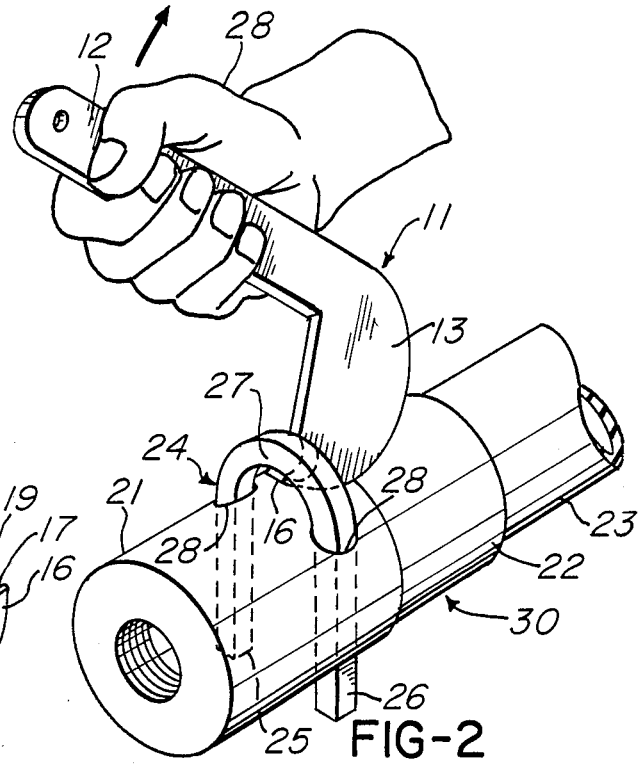
FIG. 2 is a perspective view of the tool as it is inserted under the pin, prior to removal.
Figure 3:
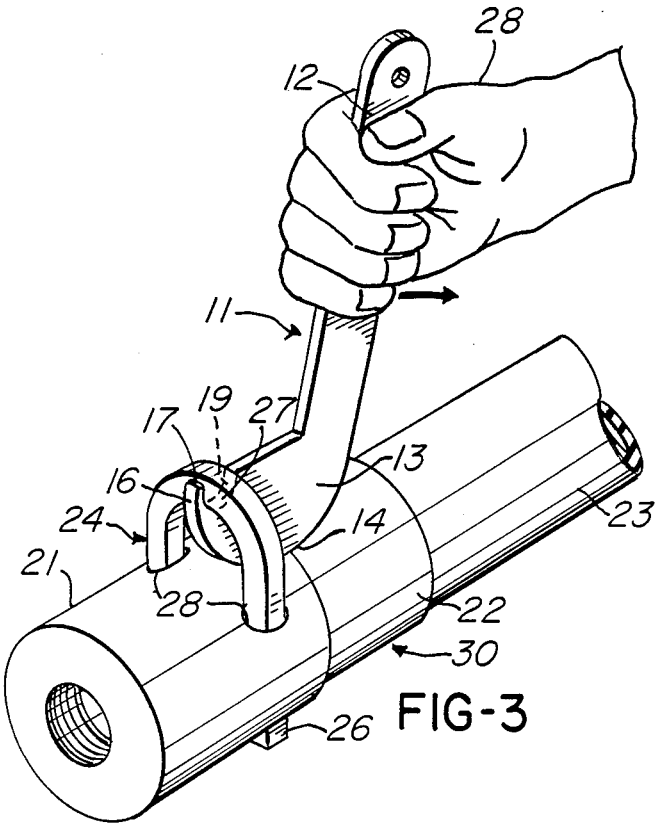
FIG. 3 is a view similar to FIG. 2, illustrating the tool during partial removal of the pin, with a hand pulling the tool.
Figure 4:
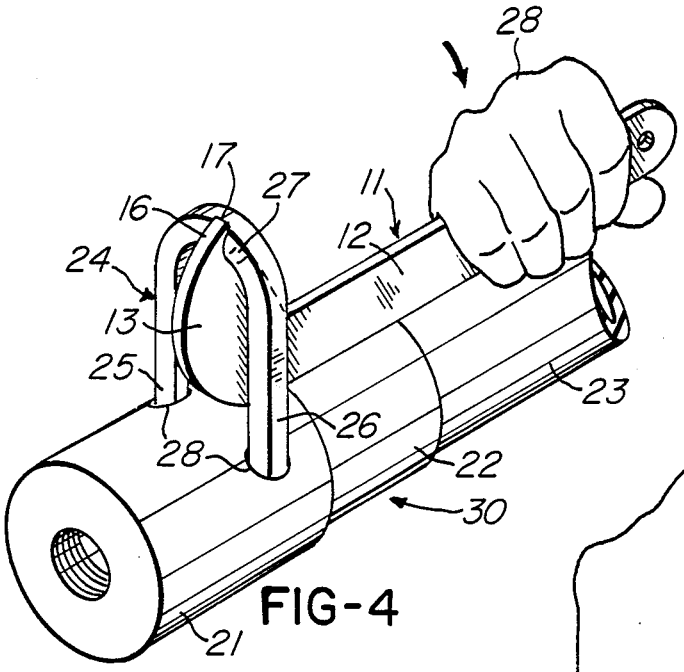
FIG. 4 is a view similar to FIG. 3, illustrating the tool immediately upon removal of the pin.

When the assembly is locked together and is to be disassembled, the pin is removed by a series of steps preferably shown in Figs 2, 3 and 4. In FIG. 2 the lip 16 is inserted under the loop 27 of the pin 24, so that the loop fits within the notch 19, this being accomplished by grasping the handle 12 with the fingers of a hand 28. Pulling further down on the handle as shown in FIG. 3 provides leverage on the pin in a outward direction, the curved surface 14 furnishing the fulcrum against the upper surface of the hose member 21. The arcuate configuration provides a constant leverage as the handle is pulled further downward. FIG. 4 illustrates the end of the pulling motion in which the notched end of the tool has been rotated far enough to pull the pin 24 completely out of the grooves of the inner member and the holes of the outer member so that these members may now be separated. If convenient, the tool may be reversed and the pin removed from the other direction.

Figure 5:
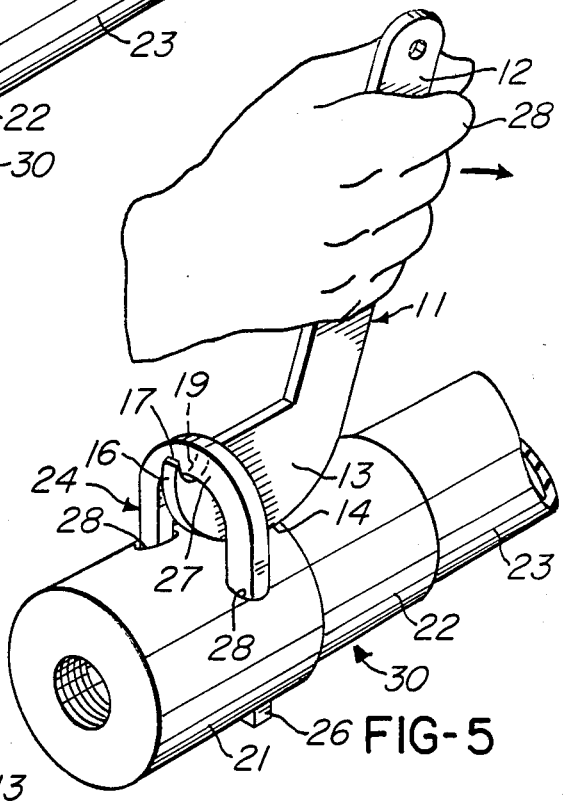
FIG. 5 is a view similar to FIG. 3, illustrating the tool during partial removal of the pin, but with a hand pushing the tool.

FIG. 5 illustrates the versatility of the tool. In this embodiment of the pin removing process, the handle of the tool is pushed by the palm of the hand, rather than pulling with the fingers. The pin is shown in this figure during the process of extraction, at the same stage as the process of FIG. 3. It is clear that the continued pushing action will remove the pin, as in FIG. 4. This type of action may be desired if the hose assembly is in a confined space such that it is not readily advantageous to use the pulling action. It should be understood that initially, of course, the lip is inserted under the loop before pushing the handle.

Figure 6:
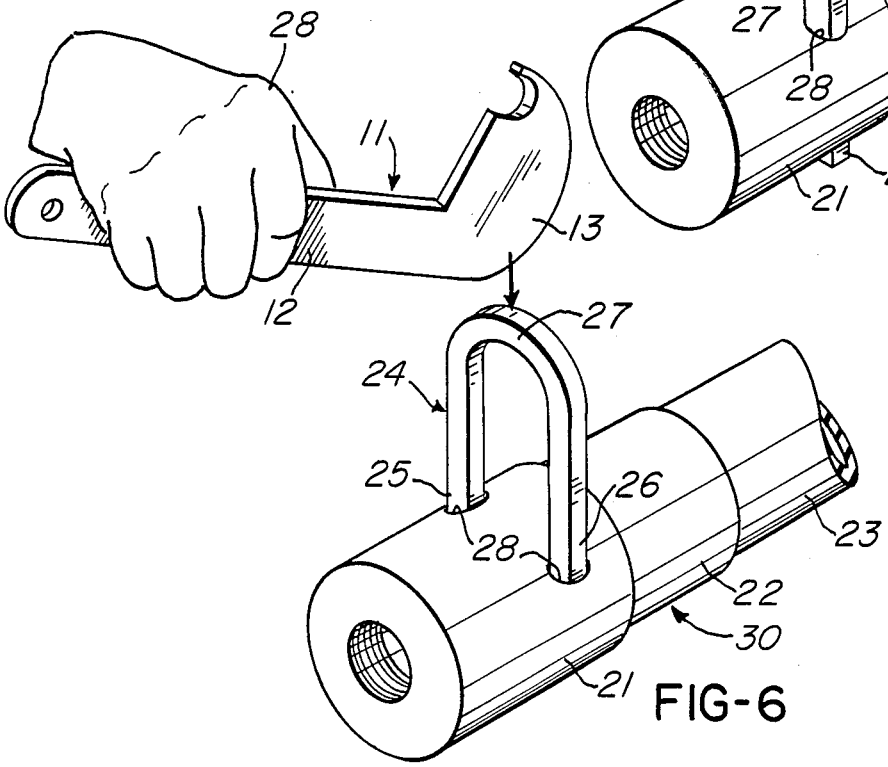
FIG. 6 is a perspective view illustrating the tool being used to insert the pin.

FIG. 6 illustrates the use of the tool for installing the pin for either an initial assembly, or an subsequent reassembly. Because of the high friction between the legs of the pin and the holes and grooves in the coupling members, it may not be easy to force the pin into place by merely using finger pressure. In this case, the tool is sturdy enough and has sufficient mass so that it may be used as a hammer to drive the pin in place.

Although the above illustrations suggest only one size of couplings and pins, many sizes are in common use. The novel tool permits a similar action for pin removal regardless of dimensions, the curved lower surface providing a simple action for all sizes.

It can thus be seen that our novel tool provides a sturdy, useful, and versatile device and method for removing and installing a fluid coupling retaining pin. The invention has been described in the form of a preferred embodiment, but such is not intended to be limiting, and other forms of the inventions are considered to be within the scope thereof.

We claim:

1. A tool for removal and installation of a retaining pin interlocking first and second coupling members wherein said pin and said members comprise a quick connect-disconnect fluid coupling assembly; the improvement wherein said tool comprises a unitary handle and a body, said handle extending at a slight angle from said body, said body having a flat upper surface and an arcuate lower surface of slightly more than about a half circle and a depth between said upper and lower surfaces of about one-fourth the overall length of said tool, one end of said lower surface merging smoothly with said handle and the other end of said lower surface forming an upward facing lip, said flat upper surface and said lip forming a semicircular notch, said lip being adapted to be slipped under a loop in said retaining pin said loop fitting within said notch, said arcuate lower surface being adapted to contact said assembly and provide a fulcrum thereagainst and provide a constant leverage in order to remove said pin.

2. The tool of claim 1 in which said tool is made of metal.

3. The tool of claim 2 in which said metal is steel.

4. The tool of claim 1 in which said tool is made of a high impact-resistant plastic.

5. The tool of claim 4 in which said plastic is polycarbonate.

* * * * *